United States Patent [19]

Held

[11] Patent Number: 4,605,331

[45] Date of Patent: Aug. 12, 1986

[54] PRESSURIZED WRITING DEVICE WITH NEEDLE WEIGHT HAVING VALVE MEANS

[76] Inventor: Kurt Held, Alte Strasse 1, 7218 Trossingen 2, Fed. Rep. of Germany

[21] Appl. No.: 686,322

[22] Filed: Dec. 26, 1984

[30] Foreign Application Priority Data

Dec. 31, 1983 [DE] Fed. Rep. of Germany ..... 3347708

[51] Int. Cl.[4] ..... B43K 8/00; B43K 5/18

[52] U.S. Cl. ..... 401/258; 401/190; 401/259; 401/260

[58] Field of Search ..... 401/258, 260, 259, 190, 401/134, 198, 199, 206

[56] References Cited

U.S. PATENT DOCUMENTS

| | | | |
|---|---|---|---|
| 238,024 | 2/1881 | Brown et al. | 401/260 |
| 263,389 | 8/1882 | Coffin, Jr. | 401/260 |
| 948,832 | 2/1910 | Trotzky | 401/260 |
| 1,033,520 | 7/1912 | Bator | 401/260 |
| 1,166,896 | 1/1916 | Garvey | 401/198 |
| 2,029,152 | 1/1936 | Bonkowski | 401/260 X |
| 2,783,488 | 3/1957 | Jockers | 401/206 |
| 3,003,182 | 10/1961 | Rosenthal | 401/199 X |
| 3,228,057 | 1/1966 | Parrish | 401/190 X |
| 3,233,275 | 2/1966 | Hansen et al. | 401/206 |
| 3,425,779 | 2/1969 | Fisher et al. | 401/190 |
| 3,561,881 | 2/1971 | Bok | 401/258 |
| 3,706,099 | 12/1972 | Jones et al. | 346/140 |
| 3,788,753 | 1/1974 | Stewart | 401/134 |

FOREIGN PATENT DOCUMENTS

| | | | |
|---|---|---|---|
| 689598 | 3/1940 | Fed. Rep. of Germany . | |
| 2129714 | 12/1971 | Fed. Rep. of Germany | 401/258 |
| 517883 | 5/1921 | France . | |
| 1571383 | 5/1969 | France | 401/134 |
| 288459 | 1/1953 | Switzerland | 401/260 |
| 5926 | 4/1891 | United Kingdom | 401/260 |

*Primary Examiner*—Steven A. Bratlie

*Attorney, Agent, or Firm*—Neuman, Williams, Anderson & Olson

[57] ABSTRACT

The invention relates to a writing device comprising a storage tank for Indian ink or another writing medium, a housing which is open in the direction of the tank, a tubular pen which is arranged on the housing, a needle which is axially displaceable in the tubular pen, and a drop weight member which is attached to the needle and is displaceable in the interior of the housing. The tank contains a propellant which is subjected to its own vapor pressure and acts directly on the writing medium, and the end of the tubular pen located in the interior of the housing is designed as a valve seat onto which a valve body formed on the oppositely located end of the drop weight member can be sealingly positioned.

10 Claims, 3 Drawing Figures

PRESSURIZED WRITING DEVICE WITH NEEDLE WEIGHT HAVING VALVE MEANS

The invention relates to a writing device comprising a storage tank for Indian ink or another writing medium, a housing which is open in the direction of the tank, a tubular pen which is arranged on the housing, a needle which is axially displaceable in the tubular pen, and a drop weight member which is attached to the needle and is displaceable in the interior of the housing.

Such writing devices are manually or machine guided and are filled with more or less viscous Indian inks or a like writing medium. With such writing devices it is imperative that a sufficient flow of writing medium is present at each writing speed to ensure uniform and clear writing. This eliminates, for example, undue thickness at the beginning of characters or interruptions in the flow of the Indian ink.

It is known in recording devices employing Indian inks, such as those in numerically controlled drawing apparatus, that the storage tank for the writing medium may be subjected to a slight excess pressure by a gas, for example, compressed air, and this excess pressure is then switched on and off by solenoid valves in accordance with the devices' Indian ink requirements. It is also possible to prevent the Indian ink from flowing out of the devices during writing intervals by producing a slight vacuum in the storage tank.

A major disadvantage of these recording instruments is the complexity of their components. Typically, a piston is arranged in the storage tank between the propellant and the writing medium, and this piston often has a tendency to bind. This impairs the sensitive control of the pressure exerted on the writing medium. Rapid pressure changes and, consequently, high writing speed and the frequency of character sequences are also often hindered by the compressibility of the gas used in these devices. The necessary tube connections between the solenoid valves and the writing medium storage tank make these apparatus difficult to handle, with the result that it is only practical to use them with machine guided recording instruments.

The object underlying the invention is to improve a generic writing device in such a way that a uniform flow of writing medium is ensured during the use of the device, with the least component expenditure and, in particular, the elimination of pressure control elements. This object is attained in the invention by introducing a propellant into the storage tank for the writing medium that is subject to its own vapor pressure to act directly on the writing medium, and by designing the end of a tubular pen located in the interior of the device's housing as a valve seat with a corresponding valve body formed at the oppositely located end of a drop weight member so that they may be sealingly positioned.

The following description of a preferred embodiment serves in conjunction with the appended drawings to explain the invention in greater detail.

Figure 1:
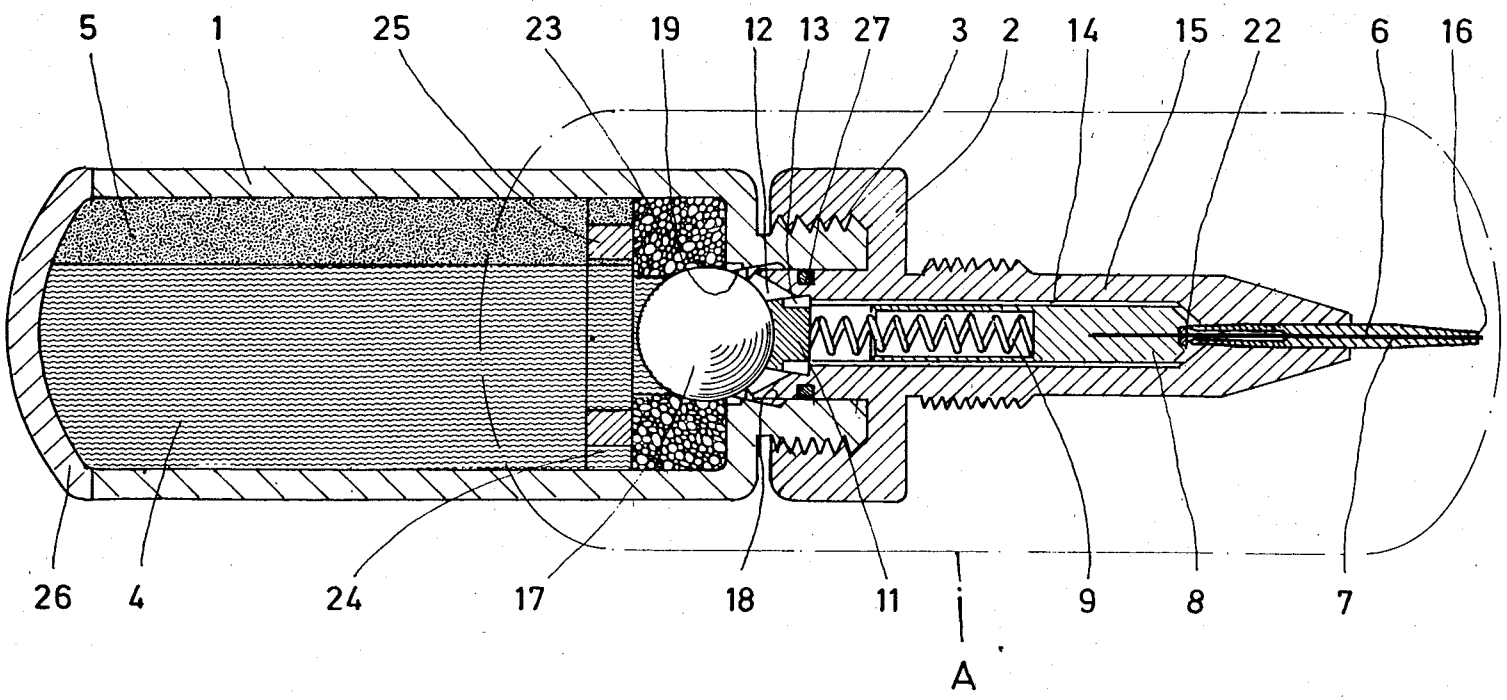
FIG. 1 is a longitudinal sectional view of a device for writing with Indian ink.
Figure 2:
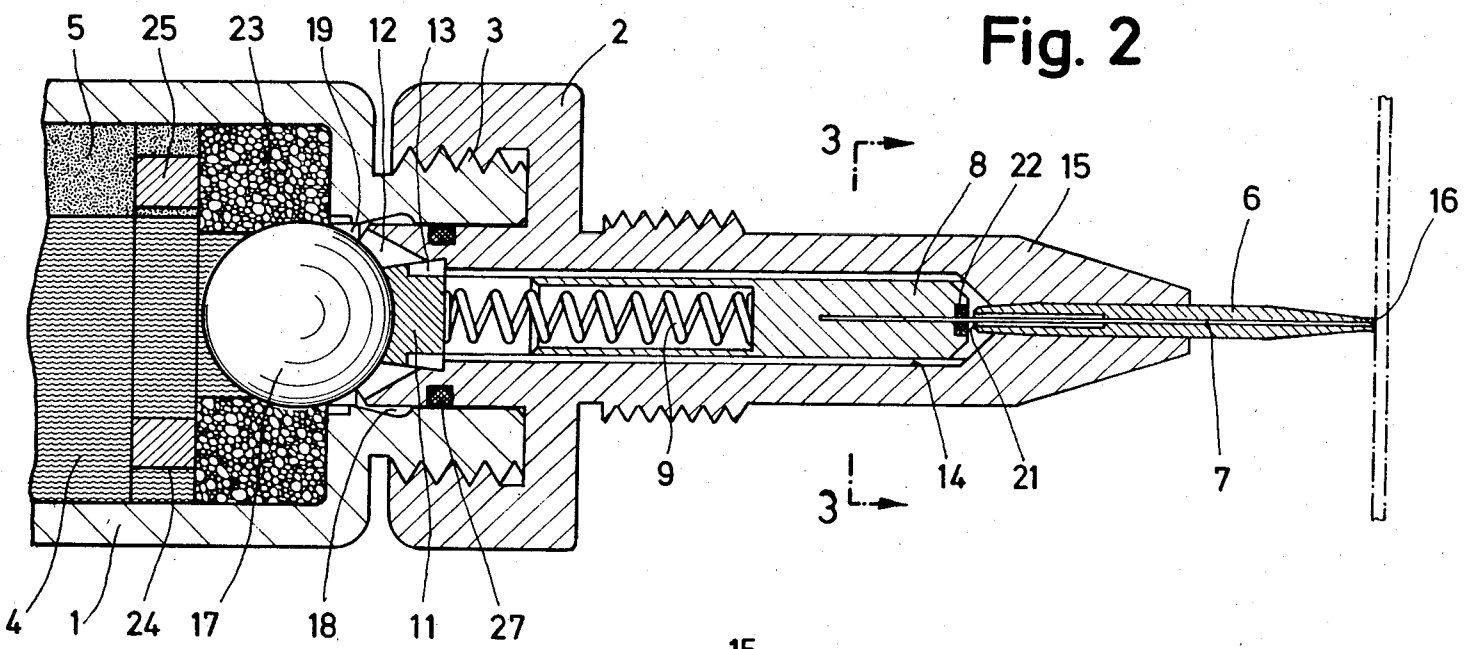
FIG. 2 is an enlarged sectional view in the area A of FIG. 1.

The writing device illustrated in the drawings consists of a storage tank 1 with a housing 2 screwed onto one of its ends by means of a thread connection 3. The tank 1 which is hermetically sealed on all sides and contains a supply of Indian ink or another writing medium 4, and also a propellant 5 which is introduced into the tank in the form of a so-called "liquid gas" in a small amount together with the writing medium 4. A halogenated hydrocarbon such as "Frigen" (fluorocarbons) or the like is, for example, suitable as propellant. The propellant 5 is constantly kept in the storage tank 1 and is subjected to its own vapor pressure, which is preferably between approximately 1 and 5 bar, in particular, 1 and 3 bar, at room temperature. Instead of a special propellant, a writing medium which develops a vapor pressure of the above-mentioned magnitude at room temperature and is constantly subjected to the action of this pressure in the storage tank could be used.

Firmly inserted into the free end of the housing 2 in a manner known per se is a tubular pen 6, in whose axial bore a needle 7 of smaller diameter than the diameter of the bore is freely displaceable. When the writing device is not in use, the needle 7 protrudes approximately 0.2 mm beyond the free end of the tubular pen 6. The needle 7 is rigidly connected in a likewise known manner to a drop weight member 8 which is freely displaceable in the housing 2. On shaking the writing device, the drop weight member 8 moves to and fro together with the needle 7 attached thereto, so that any dried up writing medium at the nib of the tubular pen 6 may be loosened. In the embodiment shown, the drop weight member 8 is subjected to the action of a compression spring 9 which puts the drop weight member 8 under pretension in the direction of the tubular pen 6. This compression spring is, however, not absolutely essential to the mode of operation of the writing device. A plug 11 which is clamped into the housing 2 with snap action serves as abutment for the compression spring 9.

As apparent from the illustration, the housing 2 comprises an annular-gap-shaped opening 12 oriented in the direction of the storage tank 1, between housing wall and safety plug 11. The opening 12 continues through recesses 13 in the safety plug 11 into several capillary columns 14 between the wall 15 of the housing 2 and the outside of the drop weight member 8 to the center bore of the tubular pen 6, so that where the writing medium 4 flows between the inside wall of the tubular pen and the needle 7, supported by capillary action, to the nib 16 where it exits.

The storage tank 1 contains, at its end connected to the housing 2, a closure valve in the form of a sealing-off ball 17 made of rubber or another elastomer material. When the tank 1 is not yet screwed to the housing 2, the sealing-off ball 17 lies with snap action sealingly in a blocking groove 18 provided on the tank 1, in order to fulfill its closure function. When the tank 1 is screwed to the housing 2, the sealing-off ball 17 is pressed out of the blocking groove by the safety plug 11 sitting firmly in the housing 2, so that it assumes the position shown in FIG. 1 where the inlet 12 of the housing 2 communicates with the outlet 19 of the tank 1. The writing medium 4 can therefore pass under the direct action of the propellant 5 from the storage tank 1 into the housing 2 and from there along the previously described path to the nib 16.

Figure 3:
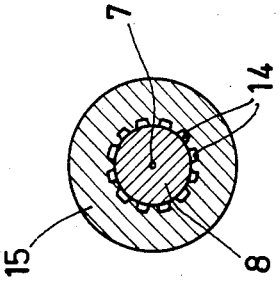
FIG. 3 is a cross-sectional view taken along the line 3—3 in FIG. 2.

The end of the tubular pen 6 located in the interior of the housing 2 is in the form of a roof-shaped cup point 21 serving as valve seat. Arranged at the end of the drop weight member 8 opposite the cup point 21 in a corresponding recess is a sealing member 22 as valve body which, while the writing device is not in use, is pressed under the action of the propellant pressure and the compression spring 9 sealingly against the cup point 21. When, during use of the writing device, the nib 16 of the tubular pen 6 is placed onto the drawing paper, the needle 7 protruding slightly from the nib 16 is pushed inwardly so that the sealing member 22 automatically lifts off the cup point 21 and the flow of the writing medium 4 from the tubular pen 6 is ensured. The valve comprised of parts 21 and 22 reliably ensures, that the writing medium, subject to the pressure of the propellant 5, is prevented from flowing out of the device when it is not in use. When the writing device is placed onto the drawing surface, the valve is opened without difficulty. On raising the writing device from the drawing surface, the valve closes immediately under the action of the propellant pressure and the compression spring 9. The drop weight member 8 is guided at the inside surface of the housing 2 provided with the capillary columns 14 (FIG. 3).

Arranged on the side of the storage tank 1 facing the housing 2, in front of the outlet 19, is a capillary sponge 23 comprised, for example, of a foamed plastic material. The sponge 23 is constantly saturated with the writing medium 4 and ensures that this medium passes into the outlet 19 under the action of the propellant 5 so that any last residues of the writing medium 4 can also be used.

The writing device illustrated and described hereinabove is not limited to use in an almost vertical position 5. The writing device may also, in particular, as illustrated in FIG. 1, be used substantially horizontally on steeply standing drawing boards or the like, in which case, the space filled with propellant is in the position drawn in FIG. 1. In the latter case, the capillary sponge 23 which is constantly filled with colour medium is also of advantage with regard to passage of the writing medium 4 under the action of the propellant 5 from the storage tank 1 into the housing 2 and the tubular pen 6.

The capillary sponge 23 is firmly held by a fastening disc 25 which is provided with apertures 24 and abuts under slight tension against the inside wall of the storage tank 1. The writing medium can flow through the apertures 24 into the capillary sponge 23.

As illustrated in FIG. 1, the sealing-off ball 17 is firmly held between the safety plug 1 and the annular capillary sponge 23. When the housing 2 and the tank 1 are joined, the sealing-off ball 17 could, however, also be pushed freely into the tank interior where it would then float on the surface of the supply of writing medium. An O ring 27 serves as a seal between the storage tank 1 and the housing 2.

The hitherto described writing device consists substantially of the cartridge-type storage tank 1 and the housing 2. When the writing medium in the tank 1 is used up, the empty tank is screwed off and exchanged for a new, full tank. In another embodiment, the tank 1 is fixed to the housing 2. When the writing medium is finished, the entire unit is disposed of. In this case, there is no sealing-off ball 17.

The storage tank 1 is, as likewise apparent from FIG. 1, closed by, for example, a welded-on cover 26. The cover 26 is mounted after introduction of the writing medium 4 and the (liquid) propellant 5. The end of the storage tank 1 which is not yet closed by the cover 26 also enables introduction of the sealing-off ball 17, the capillary sponge 23 and the fastening disc 25.

It is particularly important for the diameter of the cup point 21 to be as small as possible, for example, approximately 0.4 mm, so that the force required to close and open the valve is similarly low. Since the tubular pen 6 naturally has a small diameter, it is expedient to construct the valve in the form of the aforementioned cup point 21 directly on the end of the tubular pen 6 located in the housing 2 and to use the free end of the drop weight member 8 provided with the sealing member 22 as the valve body.

What is claimed is:

1. A writing device comprising:

a storage tank for Indian ink or another writing medium;

a propellant in the storage tank in the form of a liquid gas that is subject to its own vapor pressure and that acts directly on the writing medium contained in said tank;

a housing connected to the storage tank and open in the direction of said tank;

a tubular pen arranged on the housing, where the end of said pen situated in the interior of said housing is designed as a valve seat;

a drop weight member, displaceable in the interior of the housing, having at one end a valve body situated opposite the valve seat formed at the end of the tubular pen, so that said valve body can be sealingly positioned onto said valve seat; and a needle, attached to the drop weight member, that is axially displaceable in the tubular pen and arranged so that it may act on said drop weight member to move the valve body from its closed, sealed position of the valve seat to an open position allowing the writing medium to flow through said pen.

2. Device according to claim 1, characterized in that the valve seat on the tubular pen is in the form of a cup point.

3. Device according to claim 1, characterized in that the valve body consists of elastomer material.

4. Device according to claim 1, characterized in that the valve body is arranged as a sealing member in a recess in the drop weight member.

5. Device according to claim 1, characterized in that the needle and the valve body are arranged coaxially to one another, and the needle penetrates the valve body.

6. Device according to claim 1, characterized in that the storage tank and the housing with the tubular pen are constantly, firmly connected to one another as a disposable unit for one use only.

7. Device according to claim 1, characterized in that the storage tank is provided with a closure valve and is exchangeably connected to the housing carrying the tubular pen.

8. Device according to claim 7, characterized in that the closure valve is in the form of a sealing-off ball.

9. Device according to claim 1, characterized in that the drop weight member is prestressed by a spring against the valve seat.

10. Device according to claim 1, characterized in that a capillary sponge is arranged at the side of the storage tank adjacent to the housing where the writing medium passes through at least one outlet into the housing.

* * * * *